United States Patent [19]

Ehlers et al.

[11] Patent Number: 4,725,449

[45] Date of Patent: Feb. 16, 1988

[54] METHOD OF MAKING RADIO FREQUENCY ION SOURCE ANTENNA

[75] Inventors: Kenneth W. Ehlers, Alamo; Ka-Ngo Leung, Hercules, both of Calif.

[73] Assignee: The United States of America as represented by the United States Department of Energy, Washington, D.C.

[21] Appl. No.: 19,999

[22] Filed: Feb. 27, 1987

Related U.S. Application Data

[62] Division of Ser. No. 736,992, May 22, 1985, abandoned.

[51] Int. Cl.[4] ..... B05D 3/14

[52] U.S. Cl. ..... 427/49; 427/118; 427/120; 427/126.2; 427/126.3; 427/190; 427/193; 427/202; 427/204; 427/205; 427/374.6; 427/374.7

[58] Field of Search ..... 427/49, 118, 120, 126.2, 427/126.3, 190, 193, 202, 204, 205, 374.6, 374.7

*Primary Examiner*—Bernard D. Pianalto

*Attorney, Agent, or Firm*—Clifton E. Clouse, Jr.; Roger S. Gaither; Judson R. Hightower

[57] ABSTRACT

In the method, the radio frequency (RF) antenna is made by providing a clean coil made of copper tubing or other metal conductor, which is coated with a tacky organic binder, and then with a powdered glass frit, as by sprinkling the frit uniformly over the binder. The coil is then heated internally in an inert gas atmosphere, preferably by passing an electrical heating current along the coil. Initially, the coil is internally heated to about 200° C. to boil off the water from the binder, and then to about 750° C.–850° C. to melt the glass frit, while also burning off the organic binder. The melted frit forms a molten glass coating on the metal coil, which is then cooled to solidify the glass, so that the metal coil is covered with a thin continuous homogeneous impervious glass coating of substantially uniform thickness. The glass coating affords complete electrical insulation and complete dielectric protection for the metal coil of the RF antenna, to withstand voltage breakdown and to prevent sputtering, while also doubling the plasma generating efficiency of the RF antenna, when energized with RF power in the vacuum chamber of an ion source for a particle accelerator or the like. The glass frit preferably contains apprxoimately 45% lead oxide.

14 Claims, 5 Drawing Figures

METHOD OF MAKING RADIO FREQUENCY ION SOURCE ANTENNA

The United States Government has rights in this invention pursuant to Contract No. DE-ACO3-76SF00098 between the U.S. Department of Energy and the University of California.

This is a division of application Ser. No. 736,992 filed May 22, 1985, abandoned.

FIELD OF THE INVENTION

This invention relates to a new and improved method of making a radio frequency (RF) ion source antenna, for use in supplying radio frequency power to produce a high density ionized gas plasma in a vacuum chamber of an ion source for an accelerator or the like. The plasma may comprise ionized hydrogen, deuterium or the like, supplied at a low pressure to the vacuum chamber.

This invention also relates to an improved radio frequency ion source antenna, as provided by the method of the present invention.

BACKGROUND OF THE INVENTION

An ion source for an accelerator or the like generally comprises a vacuum chamber in which a low pressure gas, such as hydrogen, deuterium or the like, is ionized to produce an ionized gas plasma. It is often desirable to produce a plasma having a high ion density so that the accelerator may be supplied with a beam having a high density of charged or neutral particles, such as gas ions, atoms or molecules.

One common method of producing a high density plasma in an ion source is to provide thermionic cathode filaments which emit a copious supply of electrons, which then may be accelerated to produce an ionized gas plasma. This approach has the disadvantage that thermionic cathode filaments often have a very short operating life of only a few hours, for example. Moreover, the electrically heated filaments produce considerable heat which may cause operating problems.

Another method of producing a dense ionized gas plasma is to supply radio frequency power to the vacuum space. Generally, a small thermionic cathode filament is provided to emit electrons so that there is initial ionization of the ionizable gas, which then derives additional energy from the radio frequency power so that a dense ionized gas plasma is produced. Thus, in a manner of speaking, the radio frequency power heats or increases the energy level of the ionized gas so that a dense plasma is produced.

The radio frequency power is supplied to the ion source by an RF antenna in the vacuum chamber. The RF antenna coil has power lead-ins which extend through seals in the walls of the vacuum chamber and are connected to an RF amplifier or other generator, outside the vacuum chamber. The RF power often has a frequency in the range of one to two megahertz.

The RF antenna often takes the form of an elongated electrical conductor formed into a coil.

Frequently, the antenna coil may be made of copper tubing.

Problems have been encountered with such radio frequency ion source antenna coils. When the antenna coil is made of bare metal, such as copper, sparking or arcing may occur in the vacuum chamber, both between the turns of the coil, and also between the coil and various electrodes which may be employed in the ion source. When the antenna coil is operated at high power levels, the RF voltage between different portions of the coil may be quite high. Moreover, electrodes may be employed in the ion source to produce accelerating voltages which are quite high, so that sparking or arcing may occur.

When a bare antenna coil is employed in an ion source, problems are often encountered with sputtering of the copper or other metal from the antenna coil, due to ion bombardment of the antenna coil. The sputtered copper or other metal is deposited on other surfaces within the vacuum chamber of the ion source, and may cause problems, such as current leakage or short circuits between electrodes.

An attempt has been made to deal with these problems of voltage breakdown, sparking, arcing and sputtering by covering the bare antenna coil with sleeving material made of woven glass or quartz fibers, to act as electrical insulation. This approach reduces sputtering but does not eliminate sputtering as a problem. Moreover, the woven glass or quartz sleeving provides only limited protection against voltage breakdown, sparking and arcing, without eliminating them as problems.

Moreover, the woven glass or quartz sheathing introduces the additional problem of causing the evolution of contaminating gases, such as oxygen and water vapor, which are driven out of the woven glass or quartz material during the operation of the ion source, largely due to the heat generated in the ion source during normal operation.

The principal object of the present invention is to provide a method of making a radio frequency ion source antenna which deals much more effectively with the problems of voltage breakdown, sparking, arcing and the evolution of contaminating gases.

SUMMARY OF THE INVENTION

In accordance with the present invention, this object is accomplished by providing a method of making a radio frequency ion source antenna, comprising the steps of providing a clean electrically conductive metal antenna coil having power lead-ins, coating the coil with a tacky organic binder, coating the binder with a fine powdered glass frit having a melting temperature lower than the melting temperature of the metal of the antenna coil, heating the coil internally to a temperature between the melting temperature of the glass frit and the metal melting temperature to melt the glass frit and to cause the melted glass frit to flow as a coating of melted glass of substantially uniform thickness over the surface of the antenna coil while burning off the organic binder, and cooling the coil to solidify the melted glass as an adherent glass coating on the antenna coil.

The internal heating of the coil is preferably accomplished by passing an electric current along the coil to heat the coil resistively. Ordinary 60 hertz alternating current may be employed to heat the coil.

The heating and cooling of the coil are preferably done in an inert gas atmosphere, such as argon. Preferably, the internal heating of the coil is done in two stages. Initially, the coil is heated to a temperature above 100° C., preferably to about 200° C., until the water is boiled out of the organic binder. The coil is then heated to a higher temperature to melt the glass frit and to burn off the organic binder. This higher temperature may range from about 750° C. to 850° C., and preferably is about 800° C.

The glass frit is preferably a lead glass frit containing lead oxide in an approximate concentration of 45%. This glass frit sinters or melts in the temperature range of about 750°-850° C., well below the melting temperature of copper, and also well below the softening temperature of copper. The antenna coil is preferably made of copper tubing, which is thoroughly cleaned before the organic binder is applied.

The present invention provides a radio frequency ion source antenna, comprising an elongated electrical conductor made of metal and generally in the form of a coil having power lead-ins with terminal portions, the coil having an outer surface covered with a thin dielectric material in the form of a continuous impervious substantially uniform coating made of glass which is fused and strongly adherent to the surface of the coil and the lead-ins except for the terminal portions.

The glass of the dielectric coating has a melting temperature substantially lower than the melting temperature of the metal of the electrical conductor. Such conductor is preferably made of copper tubing, while the glass of the dielectric coating is preferably a lead glass made with a lead oxide concentration of approximately 45%.

The glass coating on the antenna has a substantially uniform thickness on the order of several one-thousandths of an inch, preferably about five one-thousandths of an inch.

The glass coating is highly resistant to voltage breakdown and will withstand five kilovolts, so that the problems of sparking and arcing are substantially eliminated.

The glass coating substantially eliminates the sputtering of copper from the antenna. Moreover, the surface of the glass coating floats electrically at approximately the potential of the surrounding plasma, which may be substantially above the potential of the antenna, so that ion bombardment of the glass coating is greatly reduced. Moreover, any bombarding ions have greatly reduced energies.

There is very little evolution of contaminating gases from the glass coating, so that this problem is substantially eliminated.

The glass coating is thin and uniform and is remarkably resistant to cracking during normal operation of the RF antenna. The thin uniform coating has a degree of flexibility which makes the coating resistant to cracking due to vibration.

Moreover, the coefficient of thermal expansion of the thin glass coating is sufficiently close to the coefficient of expansion of the copper tubing to afford a high degree of resistance to thermal stresses. Thus, the antenna is capable of withstanding a remarkably high thermal flux.

BRIEF DESCRIPTION OF THE DRAWINGS

Further objects, advantages and features of the present invention will appear from the following description, taken with the accompanying drawings, in which.

DETAILED DESCRIPTION OF AN ILLUSTRATIVE EMBODIMENT

Figure 1:
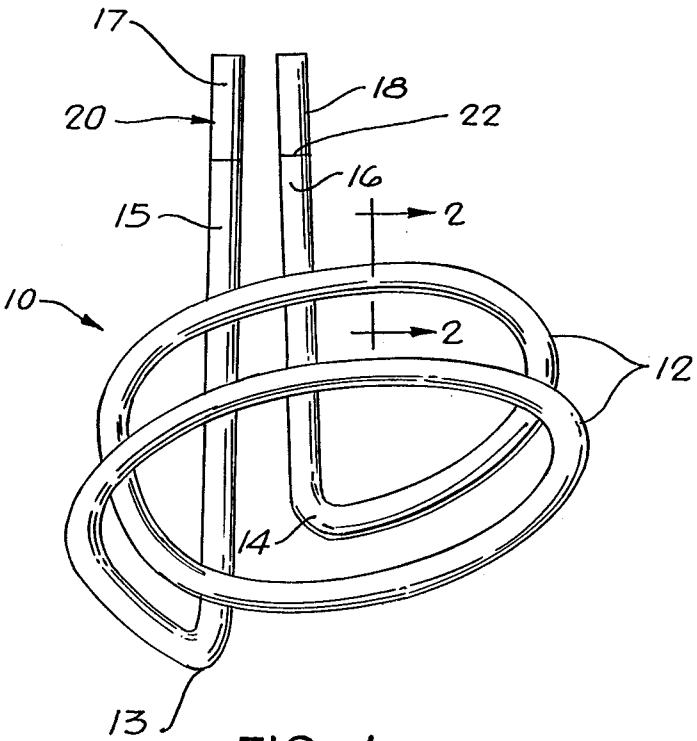
FIG. 1 is a somewhat diagrammatic perspective view showing a radio frequency ion source antenna to be described as an illustrative embodiment of the present invention.

FIG. 1 illustrates a radio frequency ion source antenna 10 having a continuous elongated conductor in the form of a coil 12, which in this case is helical in form but may assume various other forms. The coil 12 has end portions, bent from the coil, as at 13 and 14, and extending away from the coil to provide lead-ins 15 and 16 having bare terminal portions or contacts 17 and 18.

For various applications, the RF antenna coil 12 may vary in size and in the number and spacing of the turns of the coil.

Figure 2:
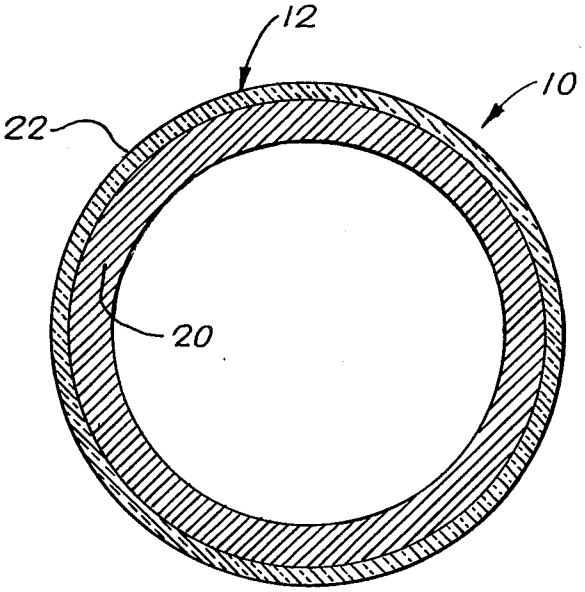
FIG. 2 is an enlarged sectional view, taken generally along the line 2—2 in FIG. 1.

As shown in FIG. 2, the antenna is made of electrically conductive metal tubing 20, forming the body of the antenna. The tubing 20 is preferably made of copper but may be made of other suitable metals. As shown, the tubing 20 is circular in cross section, but may assume other forms.

In accordance with the present invention, the metal conductor 20 of the RF antenna 10 is coated with a thin impervious layer or coating 22 of glass which is fused to the metal conductor and is strongly adherent thereto. The glass coating 22 covers the entire surface of the antenna conductor 20, including the coil 12, the bent portions 13 and 14, and the lead-ins 15 and 16, but not including the terminal portions or contacts 17 and 18, which are left bare. The glass coating 12 is thin, continuous, impervious and substantially uniform in thickness. It has been found that the optimum thickness of the glass coating 22 is approximately 5 mils, corresponding to about 0.12 millimeter. It will be understood that one mil is one one-thousandth of an inch. However, the substantially uniform thickness of the coating 22 may be on the order of several mils.

The continuous, impervious glass coating 22 is an excellent electrical insulator and is resistant to voltage breakdown. It has been found that the glass coating 22, with a thickness of about 5 mils, will withstand a voltage of five kilovolts.

The continuous impervious glass coating 22 substantially prevents sputtering of copper from the RF antenna 10, when the antenna 10 is employed to produce a dense ionized plasma in the vacuum space of an ion source. Moreover, the glass coating 22 is not sputtered to any substantial extent, because the surface of the glass coating 22 floats electrically at a potential above the potential of the antenna conductor 20, so that the potential at the surface of the glass coating is approximately the same as or close to the potential of the surrounding ionized plasma. Thus, the glass coating 22 reduces the energy of any ions which may bombard the antenna, so that there is no substantial sputtering of the glass coating.

During normal operation of the ion source, after initial out-gasing, the glass coated antenna does not evolve gases or vapors to any substantial extent.

The present invention includes a new and improved method of making the radio frequency ion source antenna 10, by applying the glass coating 22 to the copper or other metal conductor 20 of the antenna 10.

Figure 4:
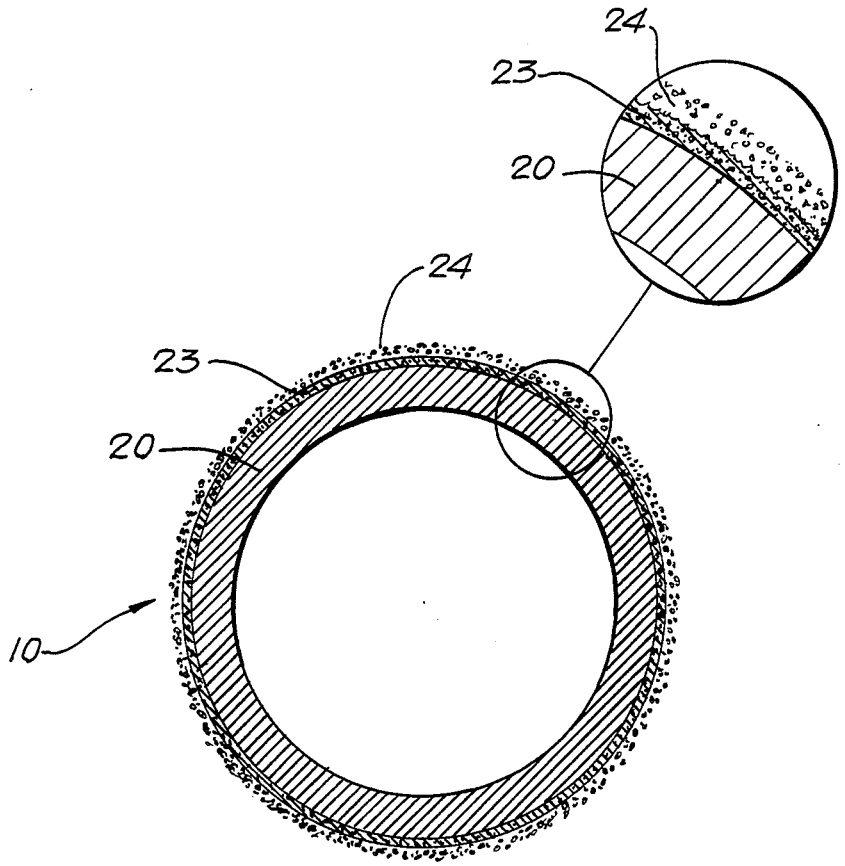
FIG. 4 is an enlarged cross section through the antenna, illustrating steps in a method of making the antenna, and specifically illustrating the coating of the antenna coil with a tacky organic binder and with powdered glass frit.
Figure 5:
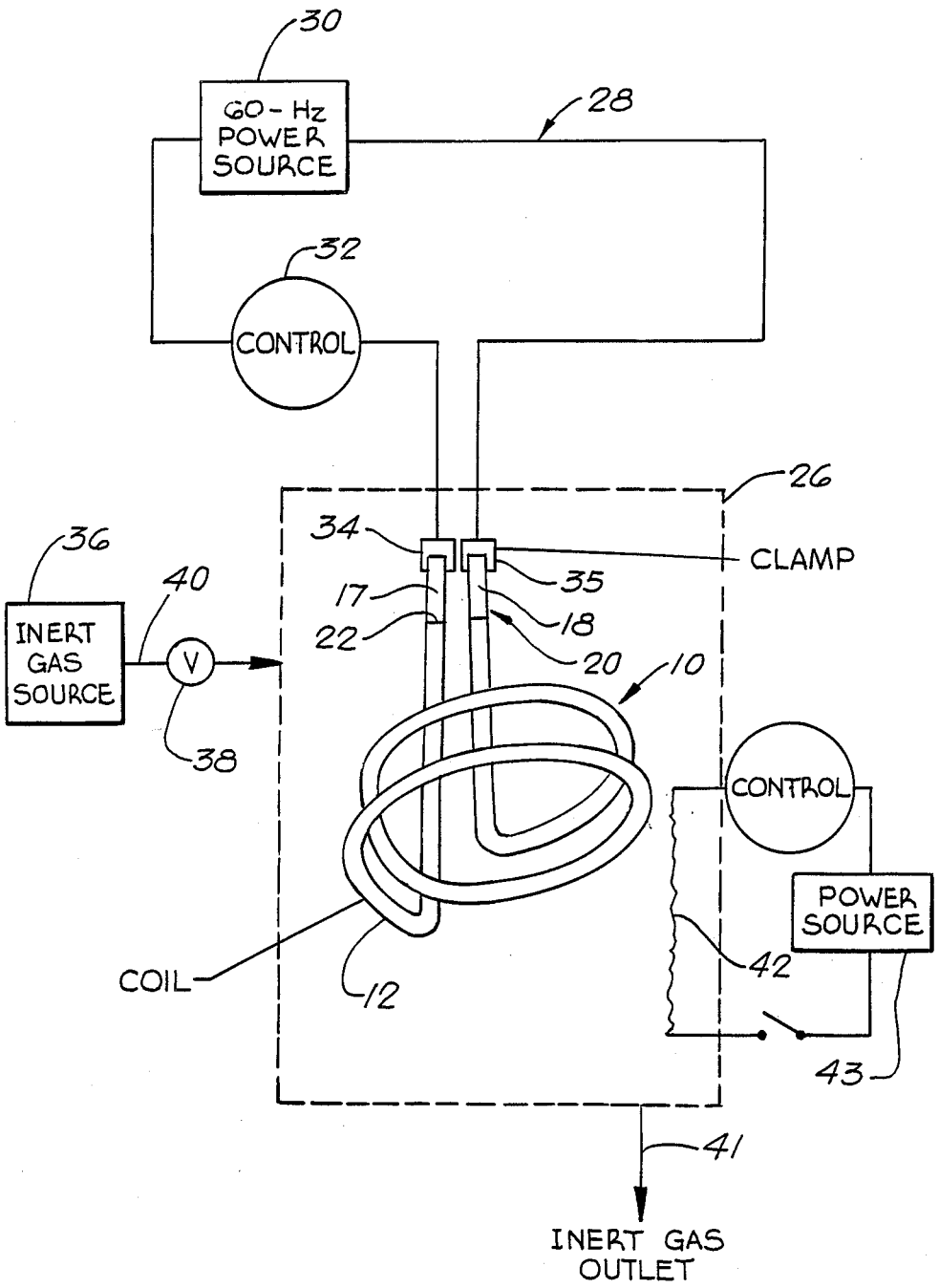
FIG. 5 is a schematic view illustrating additional steps in the method of making the antenna, including the steps of placing the frit-coated antenna in an inert atmosphere, internally heating the antenna by passing an electric current along the antenna, and cooling the antenna to solidify the liquid glass coating thereon.

FIGS. 4 and 5 show an illustrative embodiment of the method. In general, the method comprises the initial step of thoroughly cleaning the copper tubing conductor 20, so that it has a clean bare metal surface, substantially free from any contaminating materials. A thin, tacky coating 23 of an organic binder or gum is then applied to the bare metal surface of the conductor 20, as shown in FIG. 4.

Next, a coating or layer 24 of powdered glass frit is applied to the tacky binder coating 23, so that the glass frit 24 adheres to and becomes imbedded in the binder coating 23. The glass frit 24 has a composition such that it has a melting temperature substantially less than the melting temperature or the softening temperature of the copper conductor 20.

As shown in FIG. 5, the antenna 10 is placed in an oven or other enclosure 26 which is then supplied with an inert gas atmosphere, consisting, for example, of argon. The enclosure 26 is preferably flushed continuously with the inert gas during the subsequent steps of the method. The inert atmosphere prevents oxidation or other chemical contamination of the copper surface. Moreover, the flushing of the enclosure 26 with the inert gas removes water vapor and gases which are evolved by the antenna 10 during the subsequent steps of the method.

The antenna 10 is heated internally, preferably by causing an electric current to flow along the conductor 20 of the antenna 10. Preferably, the heating of the antenna 10 is done in two stages. Initially, the antenna 10 is heated to a relatively low temperature, such as 200° C., above the boiling point of water (100° C.), to boil off the water from the binder 23 and the glass frit 24. When the water has been driven off, the current along the conductor 20 of the antenna is increased so as to heat the antenna to a substantially higher temperature, sufficiently high to sinter or melt the glass frit 24, while also burning off the organic binder 23. This higher temperature is above the melting temperature of the glass frit 24, but substantially below the melting temperature or the softening temperature of the metal conductor 20. The flushing action of the inert gas atmosphere carries away the water vapor and the gases which are evolved when the organic binder is burned off.

The sintering or melting of the glass frit 24 converts it into a thin molten glass coating which adheres strongly to the surface of the metal conductor 20 and spreads evenly over the metal surface, so that the thickness of the molten glass coating is uniform. The molten glass coating has a wet, transparent appearance.

As the final step of the method, the antenna is cooled to cause the molten glass coating to solidfy, so that it forms the solid continuous impervious glass coating 22 on the surface of the metal conductor 20, as illustrated in FIG. 2. The cooling of the antenna 10 is accomplished by discontinuing the internal heating of the antenna 10 and allowing the antenna to be cooled by the inert gas atmosphere, which continues to be flushed through the enclosure 26 until sufficient cooling has been accomplished. The antenna 10 is then ready to be installed in an ion source. The terminal or contact protions 17 and 18 of the antenna 10 are not coated but are left with bare metal surfaces.

The best known mode of initially cleaning the surface of the copper tubing conductor 20 involves the initial step of degreasing the surface by washing the surface with a degreasing solvent. The copper tubing 20 is then cleaned by use of an acid bath, such as hydrochloric acid, to remove oxides, sulfides and other chemical contaminants which may be on the surface of the tubing. The antenna is then thoroughly washed by rinsing the tubing with clean water, which may be ordinary tap water. Any residual water is removed from the copper tubing antenna by washing it with alcohol, which is allowed to evaporate, so that the copper surface of the antenna is completely clean and dry.

The tacky binder or gum coating 23 is then applied to the antenna 10, while masking the teminal or contact portions 17 and 18. The binder is preferably a dilute water base organic binder or gum.

As to the tacky organic binder, the best known mode is to employ a commercially available water base liquid organic binder or gum preparation sold by American Art Clay Company, Inc. (AMACO) of Indianapolis, Ind., identified by AMACO as P/N 41372P. This liquid binder preparation is diluted with water in the proportion of one part of the commercial binder preparation mixed with five parts of water. The proportionate amount of water employed in the dilution can be varied to achieve the desired consistency. The diluted organic binder is sprayed uniformly on the surface of the conductor 20 of the RF antenna 10. It is also possible to brush the liquid binder upon the surface of the antenna, but spraying is believed to be the best mode of application.

The powdered glass frit 24 is then sprinkled uniformly over the thin tacky organic binder coating 23. The glass frit is preferably a lead glass frit material, to provide a low melting or sintering temperature, substantially lower than the melting or softening temperature of copper. As to the powdered glass frit, the best known mode is to employ a commercially available glass frit sold by the above-mentioned company, AMACO, and identified by AMACO as 80 mesh metal enamel, ART 10 Clear Flux. This glass frit contains lead oxide in a concentration of approximately 45%. Glass frits having different concentrations of lead oxide may be employed. For example, the lead oxide concentration may range from about 35% to 60% to provide a melting temperature range of about 600° C. to 800° C.

It is possible to mix the dilute binder solution and the glass frit and to apply them simultaneously to the antenna 10, but it is believed to be a better mode to apply the organic binder solution and the glass frit as separate, successive coatings, as described above.

As shown in FIG. 5, the RF antenna 10 is placed in the enclosure or oven 26, after the antenna has been coated with the tacky organic binder and the glass frit. Provision is made for internally heating the RF antenna 10. In the best mode, internal heating is produce by passing an electric current along the conductor 20 of the antenna. For this purpose, the terminals or end contact portions 17 and 18 of the antenna 10 are connected into an electric power circuit 28, which may include a conventional 120-volt 60 hertz alternating current power source 30 and a power control 32, whereby the amount of electrical current in the heating circuit can be varied from zero to some maximum level, sufficient to heat the RF antenna 10 to a temperature above the melting temperature of the glass frit. The antenna 10 is thus heated by internal electrical resistance heating.

As shown in FIG. 5, the antenna 10 is supported mechanically in the enclosure 26 by clamps 34 and 35, engaging the end terminals or contacts 17 and 18, and also serving to supply the electrical heating current to the terminals.

The enclosure 26 of FIG. 5 is supplied with an inert gas atmosphere which is flushed through the enclosure during the heating and cooling of the RF antenna 10. The inert gas, such as argon, is supplied to the enclosure 26 by an inert gas source 36, which may be, for example, an argon tank. A regulating valve 38 is connected into a supply line 40 extending between the inert gas source 36 and the enclosure 26. In order to flush the enclosure 26, the inert gas is discharged out of the enclosure 26 through an outlet line 41. The outlet line 41 may simply discharge to the atmosphere or may be connected to a system for recovering, purifying and reusing the inert gas.

Except for the inert gas flushing system, the oven or enclosure 26 is sealed during the heating and cooling of the RF antenna 10, to prevent the entry of air and the wastage of the inert gas.

In the best known mode of heating and cooling the RF antenna 10, the antenna is placed in the oven or enclosure 26, as described above, and the oven 26 is then flushed with inert gas for a period of time, such as ten to fifteen minutes, to be sure that all air has been excluded. The electrical power control 32 is then operated to cause a relatively small current to flow along the antenna 10, sufficient to heat the antenna by internal resistance heating, above the boiling point of water (100° C.) to a temperature on the order of 200° C. This initial heating level boils off the water from the organic binder. The water vapor is carried away by the flushing action of the inert gas.

After the water has boiled off, the electrical power control 32 is operated to increase the heating current, so that the conductor 20 of the antenna 10 will be internally heated to a higher temperature, to sinter or melt the powdered glass frit 24, while also burning off the organic binder 23. For the above-mentioned AMACO glass frit, the best known mode is to heat the RF antenna to a temperature ranging from 750° C. to 850° C., preferably about 800° C. The temperature may be measured by a pyrometer.

As the RF antenna 10 is heated to the higher temperature, the glass frit sinters or melts and is converted into a thin coating of molten glass on the surface of the conductor 20. The molten glass coating has a transparent, wet appearance. The molten glass spreads uniformly over the surface of the copper conductor 20 and produces a thin coating of uniform thickness.

As the organic binder 23 is burned off, gases are evolved which are carried away by the flushing action of the inert gas atmosphere.

After the glass frit 24 has been fully sintered or melted, to produce the thin transparent molten glass coating, the RF antenna is cooled to solidify the molten glass, so that it is converted into the thin solid glass coating 22, which is fused to the surface of the metal conductor 20 and is strongly adherent thereto. The cooling is produced by operating the electric power control 32 so as to discontinue the electric heating current. The antenna is then cooled by the inert gas atmosphere, which continues to be flushed through the enclosure 26. After the RF antenna 10 has been cooled sufficiently to solidify the glass coating 22, the antenna may be removed from the enclosure 26.

During the above-described heating of the RF antenna 10, it is generally sufficient to maintain the maximum temperature of approximately 800° C. for about five minutes, following which the antenna is allowed to cool.

As shown in FIG. 5, the oven or enclosure 26 may have a conventional heating element 42, adapted to be energized by an electrical power source 43. If used, the electrical heating element 42 would heat the RF antenna 10 externally, but it has been found that external heating does not produce a satisfactory glass coating on the conductor 20 of the antenna 10. With external heating, the sintering of the glass frit is not uniform and homogeneous, and the resulting coating is inferior, nonuniform and subject to cracking.

On the other hand, the internal electrical heating of the RF antenna 10, produced by passing an electrical current along the antenna, produces uniform, complete and homogeneous sintering of the glass frit, so that the finished glass coating 22 is continuous, impervious and uniform in thickness.

Figure 3:
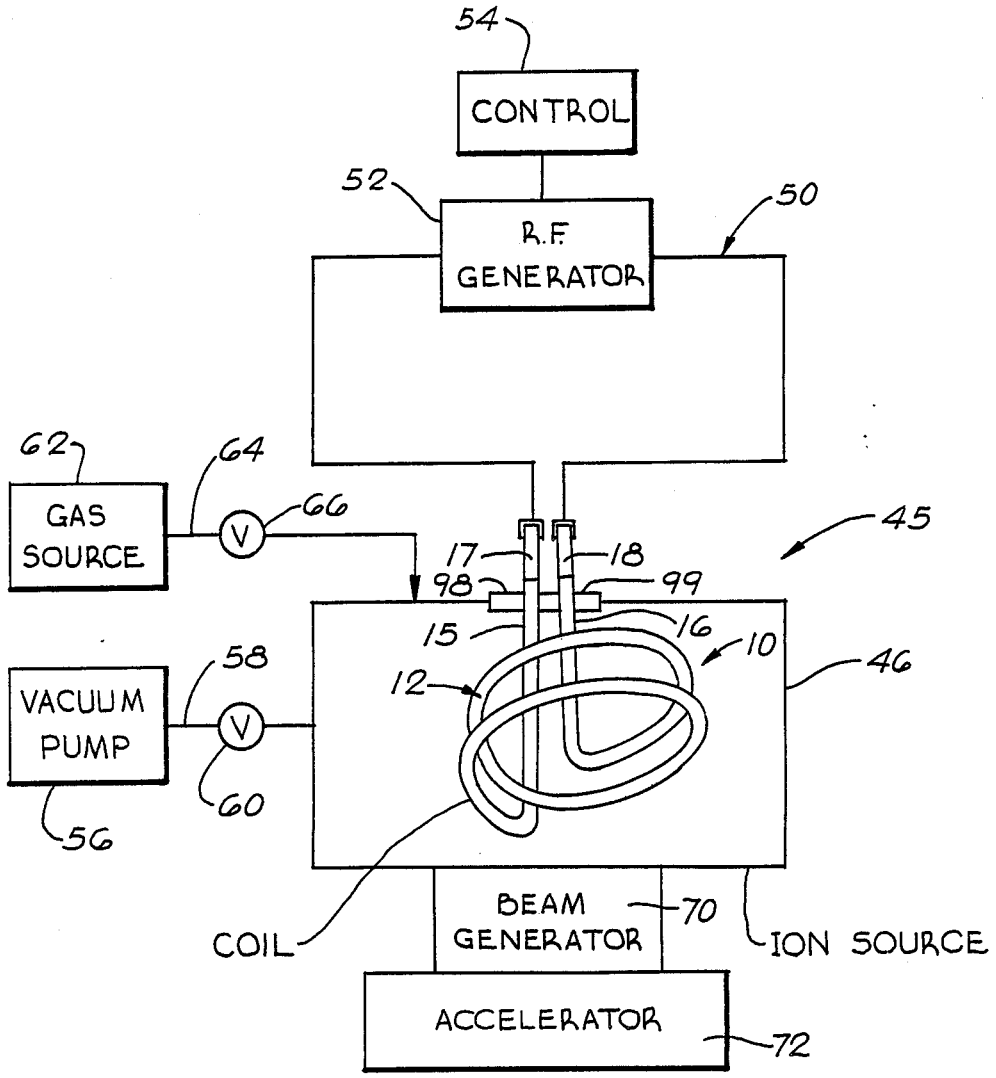
FIG. 3 is a schematic illustration of the radio frequency antenna as used to produce a high density plasma in an ion source.

FIG. 3 is a schematic illustration of the finished RF antenna, complete with its thin uniform glass coating, installed in an ion source 45 having a vacuum chamber or housing 46, within which the antenna 10 is mounted. The lead-ins 15 and 16 extend out of the vacuum chamber 46 through seals 48 and 49. The terminals or contacts 17 and 18 are connected into a radio frequency power supply circuit 50, including an RF power generator 52 having a control 54 for regulating the power supplied by the RF generator 52 to the antenna 10. The RF generator 52 may include an RF amplifier which supplies RF power at a suitable frequency, which typically may be in the range of one to two megahertz.

Generally, the ion source 45 includes means within the vacuum chamber 46 for producing initial ionization. Such means may take the form of a small electron-emitting filament, for example. The RF power supplied by the RF antenna 10 then greatly builds up the level of ionization and produces a dense ion plasma within the vacuum chamber 46.

In FIG. 3, a vacuum pump 56 is connected to the vacuum chamber 46 by a vacuum line 58 which includes a regulating valve 60. The vacuum pump 56 is operative to establish and maintain an appropriate vacuum level in the chamber 46. FIG. 3 also shows a plasma gas source 62, connected to the vacuum chamber 46 by a supply line 64 which includes a regulating valve 66. The gas source 62 may be a pressure tank containing the desired plasma gas, such as hydrogen or deuterium, to be ionized in the vacuum chamber 46, so as to produce the desired high density plasma.

As schematically shown in FIG. 3, the ion source 45 may provide a copious supply of ions to a beam generator 70 which may inject a beam into an accelerator 72. The beam generator 70 may generate a neutral beam, or a beam of particles which are either positively or negatively charged.

The thin glass coating 22 on the surface of the RF antenna 10 provides an excellent dielectric material. The glass coating 22 is continuous, homogeneous, impervious and substantially uniform in thickness. The glass coating 22 is highly resistant to voltage breakdown and will withstand five kilovolts, so that the problems of sparking and arcing are substantially eliminated.

The glass coating 22 substantially eliminates the sputtering of copper from the antenna conductor 20. Moreover, the surface of the glass coating floats electrically at or close to the potential of the surrounding ionized gas plasma, so that ion bombardment of the glass coating is greatly reduced. Moreover, any bombarding ions have greatly reduced energies, so that there is no substantial sputtering of the glass coating.

There is very little evolution of contaminating gases from the glass coating 22, so that this problem is substantially eliminated.

The glass coating is thin and uniform and is remarkably resistant to cracking during normal operation of the RF antenna. The thin uniform coating has a degree of flexibility which makes the coating resistant to cracking due to vibration and other sources of mechanical stress.

Moreover, the coefficient of thermal expansion of the thin glass coating 22 is sufficiently close to the coefficient of expansion of the copper conductor 20 to afford a high degree of resistance to thermal stresses. Thus, the glass coating is capable of withstanding a remarkably high thermal flux, without cracking or otherwise being damaged. For example, it has been found that the glass coating will withstand a heat flux of 50 watts per square centimeter. Because of this ability to withstand high levels of heat flux, the radio frequency antenna can be operated at a high radio frequency power level, to produce a high ion density in the ionized plasma.

The provision of the glass coating on the RF antenna substantially increases the ability of the antenna to withstand voltage breakdown, compared with previous antennas having the antenna conductor covered with sleeving made of woven glass or quartz fibers. It has been found that such previous antennas will withstand only about 1.25 kilovolts, while the glass coated antenna of the present invention will withstand five kilovolts.

The provision of the continuous impervious glass coating on the conductor of the RF antenna greatly increases the efficiency of the antenna, in that the glass coated antenna produces a substantially greater degree of ion density in the ionized plasma. It has been found that the provision of the glass coated antenna of the present invention doubles the ion density produced by the antenna, compared with a bare, uncoated antenna, operated at the same RF power level in the same ion source. Thus, the provision of the glass coating doubles the efficiency of the antenna. All of the reasons for this remarkable increase in efficiency are not fully understood, but the increase in efficiency appears to result from the fact that the glass coating on the RF antenna provides a continuous impervious dielectric layer which is an excellent electrical insulator.

The glass coated RF antenna of the present invention also provides a substantially greater efficiency than prior antennas in which the antenna conductor is covered with sleeving made of woven glass or quartz fibers.

The description of illustrative embodiments and best modes of the present invention is not intended to limit the scope of the invention. Various modifications, alternative constructions and equivalents may be employed, without departing from the true spirit and scope of the appended claims.

What is claimed is:

1. A method of making a radio frequency ion source antenna, comprising the steps of providing a clean electrically conductive metal antenna coil having power lead-ins, coating the coil with a tacky organic binder, coating the binder with a fine powdered glass frit having a melting temperature lower than the melting temperature of the metal of the antenna coil, heating the coil internally to a temperature between the melting temperature of the glass frit and the metal melting temperature to melt the glass frit and to cause the melted glass frit to flow as a coating of melted glass of substantially uniform thickness over the surface of the antenna coil while burning off the organic binder, and cooling the coil to solidify the melted glass as an adherent glass coating on the antenna coil.

2. A method according to claim 1, in which the coil is heated internally by passing an electric current along the coil to heat the coil resistively.

3. A method according to claim 1, in which the heating and cooling of the coil are done in an inert gas atmosphere.

4. A method according to claim 1, in which the organic binder includes water, and in which the internal heating of the antenna coil is initially done to a temperature above 100° C. until the water is evaporated, following which the coil is heated to a higher temperature to melt the glass frit.

5. A method according to claim 1, in which the organic binder includes water, the coil being heated internally by passing an electric current along the coil, such electric current being initially regulated to heat the coil to a temperature above 100° C. until the water is evaporated, following which the electric current is increased to heat the coil to a higher temperature for melting the glass frit.

6. A method according to claim 5, in which the heating and cooling of the coil are done in an inert gas atmosphere.

7. A method according to claim 1, in which the powdered glass frit is of the order of 80 mesh size.

8. A method according to claim 1, in which the glass frit is a lead glass frit containing lead oxide in an approximate concentration of 45%.

9. A method according to claim 1, in which the organic binder contains water, the internal heating of the antenna coil being done by initially heating the coil to a temperature of the order of 200° C. to drive off the water, after which the coil is heated to a temperature of the order of 750°–850° C. to melt the glass frit.

10. A method of making a radio frequency ion source antenna, comprising the steps of providing a clean electrically conductive metal antenna coil having power lead-ins, coating the coil with a tacky organic binder, coating the binder with a fine powdered glass frit containing lead oxide in an approximate concentration of 45% and having a melting temperature lower than the melting temperature of the metal of the antenna coil, heating the coil internally to a temperature between the melting temperature of the glass frit and the melting temperature of the metal to melt the glass frit and to cause the glass frit to flow as a thin melted glass coating of substantially uniform thickness over the surface of the antenna coil while burning off the organic binder, such heating being done by passing sufficient electric current along the coil to heat the coil resistively, and cooling the coil for solidifying the melted glass to form an adherent glass coating on the coil, the heating and cooling of the coil being done while maintaining the coil in an inert gas atmosphere.

11. A method according to claim 10, in which the organic binder contains water, the heating of the coil being done by initially heating the coil to a temperature on the order of 200° C. until the water is boiled off, and then heating the coil to a temperature on the order of 750°-850° C. to melt the glass frit and to burn off the binder.

12. A method according to claim 10, in which the coil is heated to a temperature on the order of 750°-850° C. to melt the glass frit and to burn off the binder.

13. A method according to claim 10, in which the antenna coil is made of copper tubing.

14. A method according to claim 10, in which the antenna coil is made of copper tubing, the organic binder containing water, the heating of the coil being done by initially heating the coil to a temperature on the order of 200° C. to boil off the water, following which the coil is heated to a temperature on the order of 750°-850° C. to melt the glass frit and to burn off the binder.

* * * * *